United States Patent [19]

Hannouche

[11] 4,424,599

[45] Jan. 10, 1984

[54] CERVICAL PILLOW

[76] Inventor: Nabil Hannouche, 403 Andulusian Trail, Simpsonville, S.C. 29681

[21] Appl. No.: 188,304

[22] Filed: Sep. 18, 1980

[51] Int. Cl.[3] ..... A47G 9/00

[52] U.S. Cl. ..... 5/436; 5/434

[58] Field of Search ..... 5/434, 436, 435, 441; D6/201

[56] References Cited

U.S. PATENT DOCUMENTS

| | | | |
|---|---|---|---|
| D. 203,251 | 12/1965 | Barber | D6/201 |
| D. 242,388 | 11/1976 | Castelberry | D6/201 |
| 1,045,228 | 11/1912 | Weltmer | 5/434 |
| 1,861,668 | 6/1932 | Tenney | 5/441 |
| 2,589,013 | 3/1952 | Martin | 5/437 |
| 2,700,779 | 2/1955 | Tolkowsky | 5/436 |
| 2,780,472 | 2/1957 | Weldon, Sr. | 5/437 |
| 2,880,428 | 4/1959 | Forsland | 5/436 |
| 3,156,500 | 11/1964 | Kerr | 5/436 |
| 3,210,775 | 10/1965 | Jongeneel | 5/432 |
| 3,648,308 | 3/1972 | Greenwalt | 5/436 |
| 3,747,916 | 7/1973 | Benson | 5/435 |
| 3,829,917 | 8/1974 | Laittre et al. | 5/436 |
| 3,842,453 | 10/1974 | Redfield | 5/436 |
| 4,118,813 | 10/1978 | Armstrong | 5/435 |
| 4,128,272 | 12/1978 | Boyle | 5/434 |
| 4,166,459 | 9/1979 | Nightingale | 5/440 |
| 4,218,792 | 8/1980 | Kogan | 5/436 |

FOREIGN PATENT DOCUMENTS

| | | | |
|---|---|---|---|
| 1120734 | 2/1956 | France | 5/441 |
| 2263740 | 10/1975 | France | 5/436 |
| 225934 | 4/1968 | Sweden | 5/434 |
| 565533 | 8/1975 | Switzerland | 5/436 |

*Primary Examiner*—Alexander Grosz

*Attorney, Agent, or Firm*—Bailey & Hardaway

[57] ABSTRACT

A cervical pillow having a shoulder engaging portion, an occiput engaging portion, and a neck engaging portion therebetween. The cervical pillow provides continuous support from the shoulder portion to the occipital portion of the user.

7 Claims, 4 Drawing Figures

CERVICAL PILLOW

BACKGROUND OF THE INVENTION

This invention relates generally to the art of sleeping pillows, and, more particularly, to the art of cervical pillows providing corrective support.

Pillows generally used for head support during sleep are for the vast majority of people comprised of either down or foam rubber stuffing contained within an ellipsoidal cover. The geometry of a pillow during sleep is generally left to the whims of the person commanding the pillow since such pillows are generally deformable over a broad range of geometries. Several attempts to provide therapeutic support within a sleeping pillow have been provided by the prior art.

One such prior art pillow is described in U.S. Pat. No. 3,829,917 to De Laittre, deceased, et al. This pillow comprises a unitary foam rubber structure having two convex lobes having a concave head support area therebetween. The object of this therapeutic pillow is to stretch the neck muscles of the user and thus encourage a relaxed sleeping posture.

Another such pillow is described in U.S. Pat. No. 2,880,428 to A. C. Forsland. The posture pillow described therein comprises a neck support portion and a head cradle portion. Two such pillows are nestable one within the other to provide a pillow shape similar to a conventional pillow.

Another such pillow is described in U.S. Pat. No. 2,700,779 to Tolkowsky. The pillow described therein is of unitary foam rubber construction having in a central portion thereof a configuration adapted for sleep in the supine position with either end portion being adapted to receive a sleeper in the side sleeping position.

While these prior art devices provide improvement over the deformable pillows conventionally used, there still exists a need to provide a pillow which provides corrective support and proper curvature for neck support.

SUMMARY OF THE INVENTION

It is thus an object of this invention to provide a cervical pillow which provides corrective support to the neck.

It is a still further object of this invention to provide a cervical pillow which provides shoulder support as well as neck and head support.

It is a still further object of this invention to provide a cervical pillow which provides means to fix the pillow in a proper position so as to prevent unintentional dislodgment of the pillow during sleep.

It is a still further more particular object of this invention to provide a cervical pillow which provides not only corrective support, but which permits sleep without the need for muscle tension to maintain the neck and head in a corrective position.

It is a further and more particular object of this invention to provide a cervical pillow which provides continuous support from the shoulder portion to the occipital portion of the user.

These as well as other objects are accomplished by a cervical pillow having a shoulder engaging portion, an occiput engaging portion, and a neck engaging portion therebetween.

DETAILED DESCRIPTION

In accordance with this invention, it has been found that corrective and restful neck support is provided by a cervical pillow having a shoulder engaging portion, an occiput engaging portion and a neck engaging portion therebetween. The remaining description will be given with reference to the various Figures of drawing.

Figure 1:
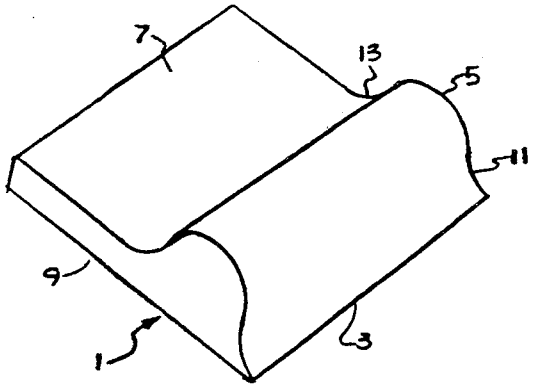
FIG. 1 is an isometric view of a cervical pillow in accordance with this invention.
Figure 2:
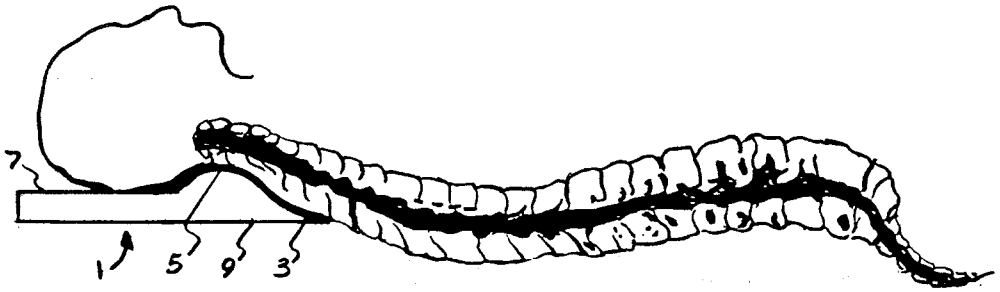
FIG. 2 of the drawing shows a cervical pillow in accordance with this invention in cooperation with a resting human anatomy.

FIG. 1 of the drawing illustrates the preferred emodiment in accordance with this invention. As is shown therein, a cervical pillow 1 has a shoulder engaging portion 3, a neck engaging portion 5, and an occiput engaging portion 7. These sections may be better seen from the illustration in FIG. 2 of the drawings, wherein the position of the pillow is shown in relationship to the human spinal anatomy.

A surprising aspect of the application of this invention is the cooperation between the shoulder engaging portion 3 and occiput engaging portion 7 when the human anatomy is in a supine position thereon. The compression of section 3 and section 5 by the weight of the human head and shoulder causes the neck engaging section 5 to expand its effective radius to provide a desired curvature for the neck section of the spinal column. Ideally the neck section for most adults has a curvature at a radius of approximately 17 centimeters. In accordance with this invention, it has been found that a radius of curvature of approximately 14 centimeters when compressed by the human anatomy in a supine position provides an effective radius of curvature of 17 centimeters for supporting the neck portion of the spinal anatomy. The neck engaging portion is of generally lobular structure as is shown in the drawings for the purpose of providing continuous support to the portions of the neck lying thereover.

In the preferred embodiment, the shoulder engaging portion 3 is formed by a concavity beginning at the termination of a neck engaging portion and continuing to the base 9 of the cervical pillow. This concavity is designated by the numeral 11 in FIG. 1 of the drawings.

It is additionally preferred that the transition between the convex neck engaging portion and occiput engaging portion comprise a concavity. The concavity is generally designated as 13 in FIG. 1 of the drawings. The concavity 13 tangentially joins the generally convex surface of the neck engaging portion and the generally flat section of the occiput engaging portion 7. It has been found that the concavity connection between the convex neck engaging portion and the shoulder engaging portion as well as the occiput engaging portion provides for gravitational assistance in the corrective action of the convex neck engaging portion. Additionally the gravitational force cooperates with the head engaging and shoulder engaging portions to force the neck engaging portion to the desired radius of curvature.

A significant advantage of the construction in accordance with this invention is the weight of the body upon the shoulder engaging portion 3 fixes the pillow so as to prevent unintentional dislodgment of the pillow during sleep.

Figure 3:
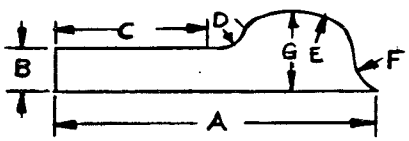
FIG. 3 is a side view of the cervical pillow of FIG. 1.

As dimensions are a significant part of the corrective action of the cervical pillow in accordance with this invention, FIG. 3 of the drawing is utilized for the purpose of describing such dimensions. The dimension "A" is 42 centimeters, dimension "B" is 4.5 centimeters, dimension "C" is 22.5 centimeters, the radius of concavity "D" is 4 centimeters, the radius "E" is 14 centimeters. The radius "F" is 10 centimeters. The general width of the pillow, which dimension is not shown in FIG. 3, is ideally 50 centimeters so as to conform with the width of a normal pillow. A pillow having such dimensions is generally adapted for a normal size adult and will conform at a radius of 17 centimeters when dimension "G" is 10.4 centimeters. For small adults and children, the dimension "G" may be reduced to 9 centimeters to provide an effective neck support region.

Figure 4:
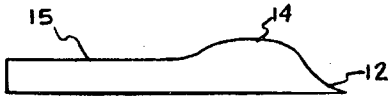
FIG. 4 is a side view of another embodiment of this invention.

FIG. 4 of the drawings illustrates an embodiment of this invention wherein the concavity between the occiput engaging portion and neck engaging portion is dispensed with as well as the concavity joining the neck engaging portion with the shoulder engaging portion. The embodiment shown in FIG. 4, however, retains a shoulder engaging portion 12, a neck engaging portion 14, and an occiput engaging portion 15. The embodiment shown in FIG. 4, however, is less preferred than the previously described embodiment because the force of gravity is less effective to provide corrective support for the neck portion of the spinal column.

The cervical pillow in accordance with this invention also provides corrective support when the user is in a position other than the supine position. When the user is in a side prone position, the height of the neck engaging portion permits the neck to overlie the neck engaging portion while the shoulder still engages the shoulder engaging portion to prevent dislodgment. The head in such position is still retained upon the intended occiput engaging portion.

As a specific example, a patient undergoing chiropractic care after using the cervical pillow of FIG. 4 for a period of three weeks experienced improved sleep and enhanced vigor. The patient retained proper adjustment for longer periods than when a conventional pillow was utilized.

The cervical pillow of this invention may be constructed of foam rubber cut to the desired geometry. The foam rubber may be reinforced to provide enhanced rigidity. Additionally the cervical pillow may have embedded therein or a cover thereon which includes heating means to provide therapeutic heat when the pillow is in use. The pillow of this invention may be covered with decorative fabric or covered with a conventional bedspread to give an ornamentally appealing appearance.

EXAMPLE

Figure 5:
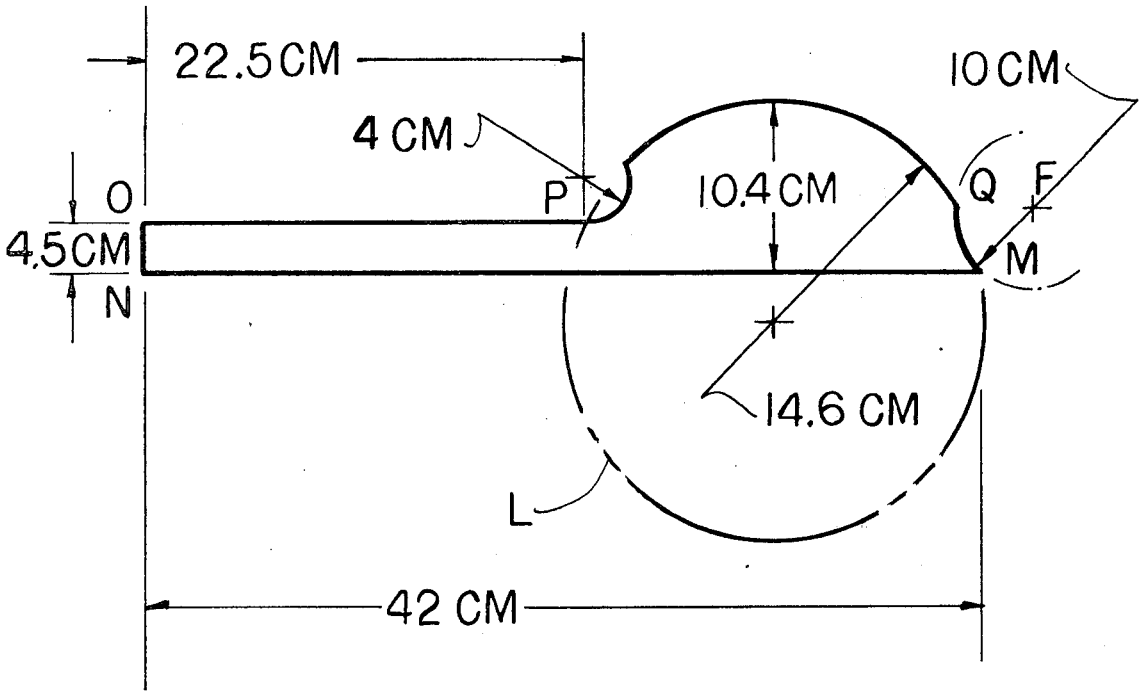

FIG. 5 of the drawing is included to exemplify the construction of a cervical pillow in accordance with this invention utilizing the perimeters previously described. As a starting point, circle "L" of 14 centimeters radius may be constructed and a portion of that radius 10.4 centimeters, cut therefrom in order to arrive at the desired height and radius of curvature for the neck engaging portion of the pillow in accordance with this invention. The base of the cervical pillow is established at 42 centimeters by measuring along the line MN and the height thereof at 4.5 centimeters established along the line NO.

The line OP is established at 22.5 centimeters. If it is desired to have a gently sloping transition between the occiput engaging portion and the neck engaging portion, and the shoulder engaging portion as illustrated in the FIG. 4 embodiment, a gently sloping transition contour connects point P with the surface of the circle L and similarly by point M with the surface of circle L.

If it is desired to produce the concavity illustrated in FIG. 3 having radii D and F as illustrated therein, radius D is 4 centimeters so as to connect point P and the surface of circle L. Similarly radius F is 10 centimeters and connects points M and Q on the surface of circle L.

It is thus seen that the cervical pillow in accordance with this invention provides corrective neck support, as well as providing continuous support from the shoulder to the occipital portion of the head and provides a means of fixing the pillow in a position so as to prevent unintentional dislodgment during sleep. The pillow in accordance with this invention also permits sleep and corrective support without muscular tension while the neck is in its desired position. As many variations will be apparent to those of skill in the art from a reading of the above specification which is exemplary in nature, the spirit and scope of this invention is measured by the following appended claims.

That which is claimed is:

1. A cervical pillow for use by an individual in a supine position upon a horizontal surface, comprising:

a shoulder engaging portion for supporting the spine between shoulders and for preventing dislodgement of the pillow during sleep;

a lobular neck engaging portion having a first radius of curvature extending across substantially the entire width of said pillow; and an occiput engaging portion being substantially planar and parallel to said horizontal surface, said occiput engaging portion being below said lobular neck engaging portion when said pillow rests upon a horizontal surface;

said shoulder engaging portion, lobular neck engaging portion and occiput engaging portion being cooperatively responsive to the weight of a user to increase the radius of curvature of said lobular neck engaging portion to a second radius of curvature of about 17 centimeters, which is a desired radius of curvature for maintaining spinal adjustment in the neck area.

2. The cervical pillow in accordance with claim 1 wherein said shoulder engaging portion is of generally uniform cross section across substantially the entire width of said pillow.

3. The cervical pillow in accordance with claim 1 wherein said occiput engaging portion has a substantially uniform cross section across substantially the entire width of said pillow.

4. The cervical pillow in accordance with claim 1 wherein said neck engaging portion tapers into said shoulder engaging portion and said head engaging portion.

5. The cervical pillow in accordance with claim 4 further comprising a concavity connecting said neck engaging portion with said shoulder engaging portion.

6. The cervical pillow in accordance with claim 4 further comprising a concavity between said lobular neck engaging portion and said occiput engaging portion.

7. A cervical pillow in accordance with claim 8 wherein said shoulder engaging portion tapers to provide both support for the shoulders and to fix the pillow position due to the entrapment of the shoulder engaging portion between the shoulders and the support surface.

* * * * *